United States Patent [19]

Royko

[11] 4,047,309

[45] Sept. 13, 1977

[54] INFORMATION DEMONSTRATION DEVICE

[76] Inventor: Patricia Diane Royko, 14 Allen Drive, Wayne, N.J. 07470

[21] Appl. No.: 628,246

[22] Filed: Nov. 3, 1975

[51] Int. Cl.[2] ..... A47B 97/08

[52] U.S. Cl. ..... 35/60; 248/461

[58] Field of Search ..... 35/60, 62, 63, 7 R; 40/72, 102, 104.02; 108/13, 38, 41; 248/441 R, 447, 456, 460, 461; 281/15 B, 33; 190/10, 11

[56] References Cited

U.S. PATENT DOCUMENTS

| | | | |
|---|---|---|---|
| 115,349 | 5/1871 | Palm | 35/60 |
| 232,599 | 9/1880 | Crandall | 35/60 |
| 1,491,123 | 4/1924 | Watkins | 35/60 |
| 2,091,260 | 8/1937 | Farkas | 248/447 X |
| 2,397,405 | 3/1946 | Burkeman | 35/62 |
| 3,056,230 | 10/1962 | Brokaw | 248/460 |
| 3,669,227 | 6/1972 | Alford | 248/461 X |
| 3,680,497 | 8/1972 | Sargeant | 35/60 X |
| 3,773,154 | 11/1973 | Mitchell | 248/461 X |

FOREIGN PATENT DOCUMENTS

| | | | |
|---|---|---|---|
| 148,292 | 9/1952 | Australia | 35/60 |
| 172,434 | 6/1906 | Germany | 35/27 |

OTHER PUBLICATIONS

Flannel Board, Milton Bradley Educational Materials Catalog, 1965–1966, p. 22 only.

*Primary Examiner*—Harland S. Skogquist

[57] ABSTRACT

A portable device for demonstrating information including a receptacle with bottom and side walls. A lid is pivotably mounted on a side wall of the receptacle and a support element is mounted on the opposite edge of the lid. Leaf elements such as felt boards and peg boards are pivotably disposed at the intersection of the lid and support element.

12 Claims, 5 Drawing Figures

INFORMATION DEMONSTRATION DEVICE

BACKGROUND OF THE INVENTION

The present invention relates to an information demonstration and teaching unit, particularly to one readily usable for teaching children.

The prior art is familiar with easel aparatus whereby drawings, cut-outs, blocks, puzzles, puppets, and other teaching aids can be demonstrated to school children. While such apparatus is a portable unit and has received widespread acceptance and favor, but the present invention provides advantages thereover.

The present invention seeks to provide a teaching apparatus that provides functional utility as well as compactness, portability, ease of use, and effectiveness for demonstrating information.

BRIEF SUMMARY OF THE INVENTION

The present teaching and demonstration device, described succinctly, generally is directed to a device for demonstrating information, comprising a receptable structure comprising a bottom and side walls, a lid element pivotably mounted at a first side thereof on a first side wall of said receptacle structure, a support element pivotably mounted at a side portion thereof on an opposite second side of said lid element and said receptacle structure comprising means for engaging a second opposite side portion of said support element.

According to a preferred embodiment of the invention, the information demonstrating device also comprises one or more sheet or leaf elements that are pivotally disposed at an edge portion thereof, to the lid element so that such further element or elements can be flipped about the point at which they are mounted on the lid element. The leaf elements individually can be, e.g., a peg board, felt board, co-ordination board, a drawing or artist board adapted to hold paper in place, and/or a writing surface comprising a waxed dark layer covered by a transparent film that can be lifted from the waxed layer to erase information written thereon with a stylus or other writing instrument.

In a still further embodiment, the device comprises engaging means at the interior surface of a side wall of the receptacle structure, which means can be a ledge or lip.

PREFERRED EMBODIMENT

Figure 1:
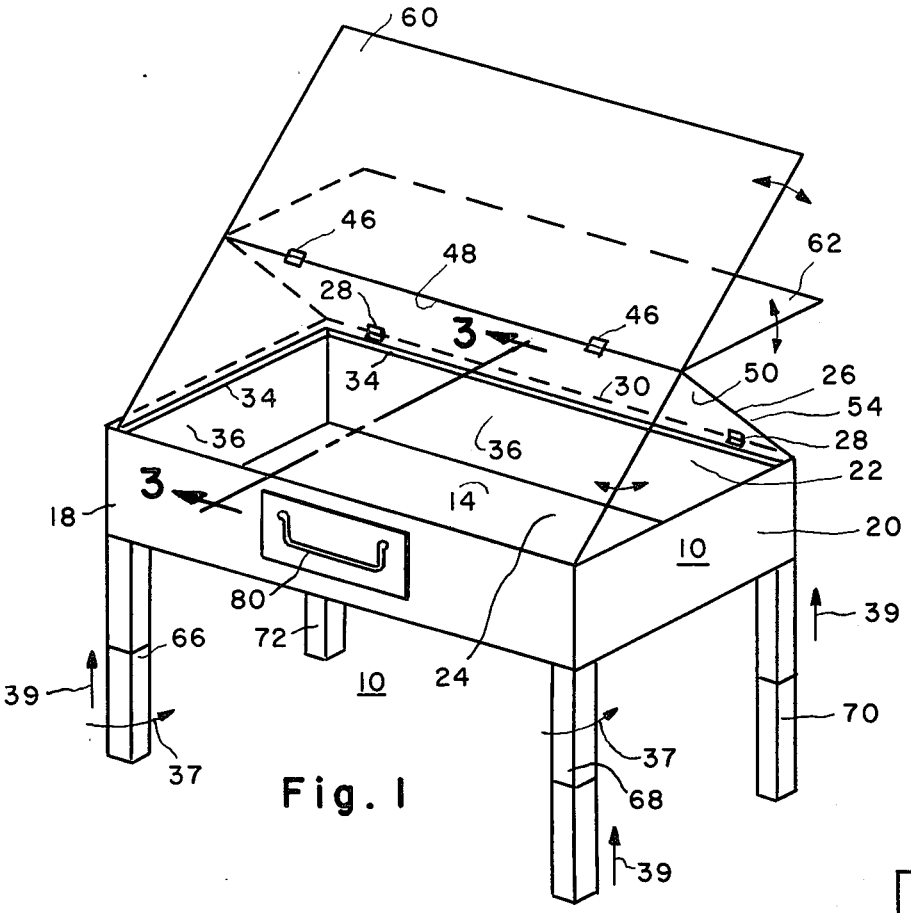
FIG. 1 is an isometric view of an embodiment of the present invention.
Figure 2:
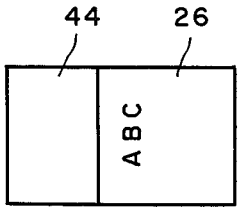
FIG. 2 is a top view of the device in FIG. 1 in use.
Figure 4:
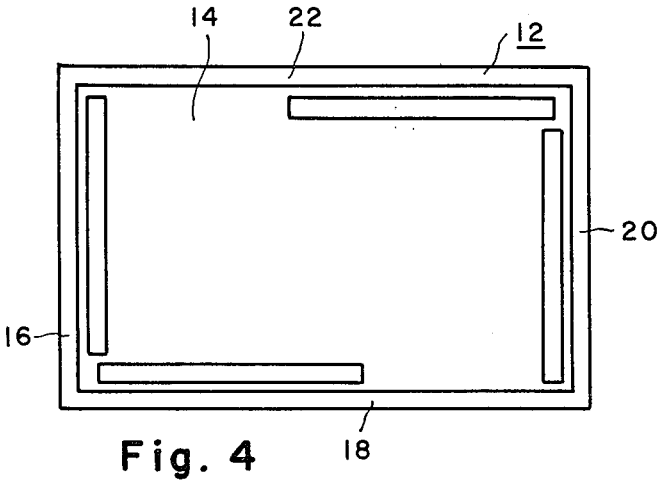
FIG. 4 is a bottom view of the device of FIG. 1 with the legs retracted.
Figure 3:
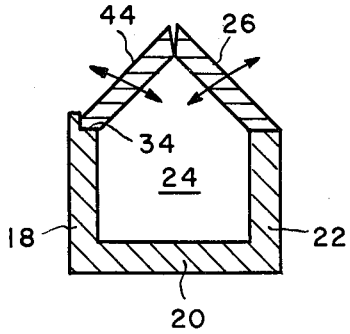
FIG. 3 is a sectional elevation view along axis 3—3 of the device of FIG. 1.
Figure 5:
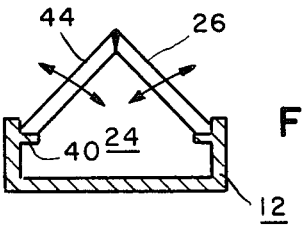
FIG. 5 is a sectional elevation view of the present invention according to a further embodiment.

Referring to FIG. 1, the present information demonstration device 10, according to a preferred embodiment, comprises a receptacle structure 12 that comprises a bottom wall 14 and side walls 16, 18, 20 and 22, that collectively form an interior space 24. The device 10 further comprises a lid element 26 that is pivotably mounted (e.g., via hinges 28, rings, or other suitable means) at a first side 30 thereof on an opposite side wall 22 of the receptacle structure 12, the lid element 26 being receivable between the various side walls 16–22 so that a closed container is formed. To this end, at least one side wall (e.g., the side, or front, wall 18) and preferably more than one, e.g., all, of the side walls can comprise a lip or ledge 34 (FIG. 3) at the interior surface 36 thereof for engaging the lid element 26 and limiting its inward motion. Such lip or ledge 34 can be an integral part of the side wall 16, 18, 20, and/or 22 associated therewith (e.g., the receptacle can be made of wood, plastic, or other suitable material so that the lip or ledge is molded, machined, or otherwise built into the wall) or it can be provided by a discrete element 40 (FIG. 5) located at the interior surface thereby providing a ledge or rim that can engage the lid element 26.

The device 10 further comprises a support element 44 that is pivotably mounted at a side or edge portion thereof (e.g., via hinges 46, rings, or other means) on another side or edge 48 of the lid element 26. The opening lid element 26 is opened via a special mechanical support element 44, that maintains element 26 in a set, or any desired position. The support element 44 preferably is movable, i.e., pivotable, at least from a first position adjacent to the interior surface 50 of the lid element 26 to one where it engages a structural element which can be the lip or ledge 34 or other suitable means.

It is more preferred, however, that the support element 44 be rotatable over 360° from the interior surface 50 of the lid element 26 to the exterior surface 54 thereof, so that the support element 44 can rest at or on the exterior surface 54.

Thus, the lid element 26 and/or the support element 44 can be adapted, as indicated below, for demonstrating or exhibiting certain information and/or for other uses.

According to another embodiment, the device 10 further comprises at least one, and preferably several, leaf elements 60, 62 that are pivotably disposed at respective edge portions thereof (e.g., via a circular ring, hinge or other means) to the edge portion 48 of the lid element so as to be pivotable or rotatable between a position adjacent to the lid element 26 and the support element 44, the leaf elements being individually rotatable and used and further described below.

According to a further embodiment, the device 10 comprises leg members 66, 68, 70 and 72 that preferably are retractable (e.g., hingedly mounted on the receptacle member 12, as shown by arrows 37), e.g., where the legs can telescope, as indicated by arrows 39. Where it is desired, the device 10 can be used on a table top or, when the legs are in position, on the floor. Alternatively, the legs can be omitted, so that the device 10 is used only as a table-top unit.

The device 10 preferably comprises a handle element 80 that permits it to be readily carried in a collapsed condition.

It is especially preferred that the lid element 26, support element 44, and/or at least one of the leaf elements comprise a peg board, with another one thereof comprising a felt board (i.e., a felt layer disposed on a rigid or semi-rigid board having clip means or other suitable structure for retaining sheets of paper or other material that can be drawn or written on), and still another thereof comprising a geometric co-ordination board having cut-out areas or shapes that are removably disposed in holes or recesses of the same configuration, which holes or recesses are located in the board itself (which preferably comprises a backing at any holes located in the board, so that the cut-out areas or shapes can be inserted in the holes without falling through). Also, the cut-out holes reinforce the child's concept of the geometric figures when the child's fingers are moving along the edges and/or if traced around the shapes via a pencil or crayon. The shapes can be letters, numbers, or otherwise. Where it is desired, one or more of these particular boards (e.g., the geometric co-ordination board) can be omitted and/or more than one particular type of board (e.g., two or more felt boards or chalk boards can be included in the device 10).

Thus, the device can be used by lifting the lid element 26 and positioning the support element 44 on the sides of element 12 (i.e., at the ledge or lip) so that both the lid and supporting elements are propped up at an angle to each other and the receptacle structure 12, with the lid element and/or support element (where they are constructed to be used for exhibiting information, play, teaching, or otherwise — i.e., where they are a peg board or other type described above or otherwise) being usable for its intended purpose. The leaf elements can be used for their intended purposes, it being possible to flip them as they are used and/or changing from one particular function (e.g., play, as with a peg board) to another (e.g., teaching, as with a chalk board, felt board or artist board).

Where it is desired, the space defined by the receptacle structure 12 and the lid element 26 can be used for storing or carrying secondary items usable with the device, e.g., chalk, crayons, pencils, finger puppets, or other items, such as those for teaching manual dexterity, which would include zippers, buttons, etc.

It is also preferred at least one of the lid element 26, support element, and leaf elements 60, 62 comprise material attracted by a magnet so that it can be used as a magnetic board.

While various uses have been described for the present invention, it is not intended that these be limiting. Also the various figures are not necessarily drawn to scale.

I claim:

1. A portable device for demonstrating information, comprising:

a. a receptacle structure comprising a bottom and side walls;

b. a lid element pivotably mounted at a first edge, thereof on a first side wall of said receptacle structure;

c. a support element pivotably mounted at an edge thereof on an opposite second edge of said lid element;

d. said receptacle structure comprising means for engaging a second opposite edge portion of said support element;

e. plural retractable legs attached to said receptacle structure; and at least one leaf element pivotably disposed at an edge portion thereof at said second edge of said lid element.

2. A device as in claim 1, wherein said engaging means comprising a ledge.

3. A device as in claim 1, wherein at least one of said lid element, support element, and leaf element comprises a peg board.

4. A device as in claim 1, wherein at least one of said lid element, support element, and leaf element comprises a felt board.

5. A device as in claim 1, wherein at least one of said lid element, support element, and leaf element comprises means for retaining paper thereon.

6. A device as in claim 1, wherein at least one of said lid element, support element, and leaf element comprises a chalk board.

7. A device as in claim 1, wherein said lid element and support element are angularly disposed with respect to each other and with said receptacle structure so that said support and lid elements and said receptacle structure together have a triangular profile.

8. A device as in claim 1, wherein at least one of said lid element, support element, and leaf element cut out portions in the form of certain information and cut out pieces removably disposed in said portions, thereby forming a composite.

9. A device as in claim 8, wherein said element comprises backing means for retaining said cut out pieces in position.

10. A device as in claim 1, wherein said engaging means is disposed at a second opposite side wall of said receptacle structure.

11. A device as in claim 10, wherein said second side wall comprises an inside surface portion facing the interior of said receptacle structure and said engaging means is disposed at said surface portion.

12. A device as in claim 11, wherein said second side wall comprises an outside surface portion at the exterior of said receptacle structure and said device further comprises handle means located at said outside surface portion.

* * * * *